US008684077B2

(12) United States Patent
Joseph et al.

(10) Patent No.: US 8,684,077 B2
(45) Date of Patent: Apr. 1, 2014

(54) WATERCUT SENSOR USING REACTIVE MEDIA TO ESTIMATE A PARAMETER OF A FLUID FLOWING IN A CONDUIT

(75) Inventors: Paul Joseph, Missouri City, TX (US); Tianping Huang, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 392 days.

(21) Appl. No.: 12/982,307

(22) Filed: Dec. 30, 2010

(65) Prior Publication Data

US 2012/0168153 A1 Jul. 5, 2012

(51) Int. Cl.
*E21B 43/12* (2006.01)
*E01F 1/00* (2006.01)

(52) U.S. Cl.
USPC ..... 166/250.03; 73/152.18; 73/861.47

(58) Field of Classification Search
USPC ..... 73/152.02, 152.18, 861.04, 64.53, 73/861.07, 861.52, 861.47, 53.01; 166/250.03, 373, 316, 305.1, 300, 205, 166/183
See application file for complete search history.

(56) References Cited

U.S. PATENT DOCUMENTS 4,576,043 A 3/1986 Nguyen
5,226,728 A 7/1993 Heyden
6,109,350 A 8/2000 Nguyen et al.
6,474,413 B1 11/2002 Barbosa et al.
7,084,094 B2 8/2006 Gunn et al.
7,114,401 B2 10/2006 Peter
7,159,656 B2 1/2007 Eoff et al.
7,395,858 B2 7/2008 Barbosa et al.
7,481,118 B2 * 1/2009 Nyfors ..... 73/861
7,516,024 B2 * 4/2009 Gysling ..... 702/48
7,762,341 B2 7/2010 Hammer
7,913,765 B2 3/2011 Crow et al.
7,942,206 B2 5/2011 Huang et al.
2005/0006090 A1 1/2005 Chemali et al.
2006/0289349 A1 * 12/2006 Hughes ..... 210/500.1
2008/0035376 A1 2/2008 Freyer
2009/0095484 A1 4/2009 Huang et al.
2009/0101355 A1 4/2009 Peterson et al.
2009/0283275 A1 11/2009 Hammer
2009/0301726 A1 12/2009 Coronado
2009/0306911 A1 12/2009 Gysling
2010/0038086 A1 2/2010 Bunnell et al.
2010/0108390 A1 5/2010 Teodorescu
2011/0036578 A1 2/2011 Coronado

* cited by examiner

*Primary Examiner* — William P Neuder
(74) *Attorney, Agent, or Firm* — Mossman, Kumar & Tyler, PC

(57) ABSTRACT

An apparatus for estimating a parameter of interest includes a conduit and a reactive media in the conduit. The reactive media interacts with a selected fluid component to control a flow parameter of the conduit. The apparatus also includes at least one sensor responsive to the flow parameter. The apparatus may be used for estimating a water content of a fluid flowing from a subterranean formation. The apparatus may include a flow path configured to convey fluid from the formation. The at least one sensor may be responsive to a pressure change in the flow path caused by interaction of the reactive media with water.

17 Claims, 4 Drawing Sheets

WATERCUT SENSOR USING REACTIVE MEDIA TO ESTIMATE A PARAMETER OF A FLUID FLOWING IN A CONDUIT

BACKGROUND OF THE DISCLOSURE

1. Field of the Disclosure

The disclosure relates generally to systems and methods for estimating water content in a fluid.

2. Description of the Related Art

Determining the amount or quantity of water or another component of a fluid may be desirable in a variety of situations. For example, hydrocarbons such as oil recovered from a subterranean formation may include a water component. Excessive amounts of water in oil flowing from a given formation may make production uneconomical or may lead to undesirable conditions in an oil bearing reservoir. Therefore, it may be desirable to quantify the amount of water in an inflowing oil in order to assess production effectiveness and to take corrective action, if needed.

The present disclosure addresses the need to estimate water content in these and other situations.

SUMMARY OF THE DISCLOSURE

In aspects, the present disclosure provides an apparatus for estimating a parameter of interest relating to a fluid. The apparatus may include a conduit, a reactive media in the conduit, the reactive media interacting with a selected fluid component to control a flow parameter of the conduit; and at least one sensor responsive to the flow parameter. In some arrangements, an analyzer may be used to estimate the parameter of interest, e.g., water content, using information from the sensor(s).

In aspects, the present disclosure also provides an apparatus for estimating a water content of a fluid flowing from a subterranean formation. The apparatus may include a flow path configured to convey fluid from the formation, a reactive media in the flow path, and at least one sensor responsive to a pressure change in the flow path caused by interaction of the reactive media with water. In some arrangements, an analyzer may be used to estimate the parameter of interest, e.g., water content, using information from the sensor(s).

In aspects, the present disclosure also provides a method for estimating a parameter of interest relating to a fluid. The method may include estimating at least one flow parameter associated with a fluid flowing along a reactive media in a conduit, the reactive media interacting with a selected fluid component of the fluid; and estimating the parameter of interest using the at least one estimated flow parameter.

It should be understood that examples of some features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE DISCLOSURE

Figure 1:
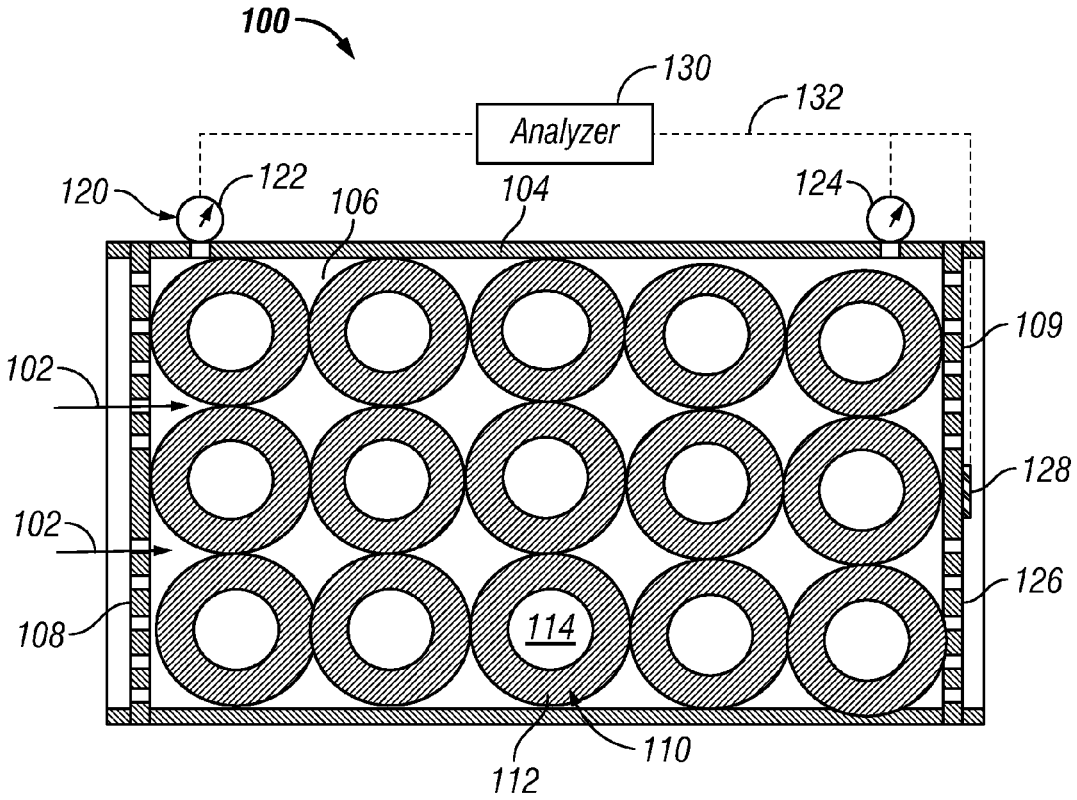
FIG. 1 is a sectional schematic view of an exemplary water monitoring device made in accordance with one embodiment of the present disclosure.

The present disclosure relates to devices and methods for estimating water content in a fluid. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas. Additionally, references to water should be construed to also include water-based fluids; e.g., brine or salt water. The present disclosure is susceptible to embodiments of different forms. There are shown in the drawings, and herein will be described in detail, specific embodiments of the present disclosure with the understanding that the present disclosure is to be considered an exemplification of the principles of the disclosure and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is schematically shown a water monitoring device 100 for estimating water content in a flowing fluid 102. The flowing fluid 102 may be a two-phase fluid (e.g., oil and water) or a multiphase fluid (e.g., water, oil, gas). In certain embodiments, the device 100 may be used to estimate a value for a water cut (i.e., a percent of water in the flowing fluid 102). In other embodiments, the device 100 may be used to estimate a change (e.g., increased or decreased) in the amount of water in the flowing fluid 102 and/or a rate of change in the amount of water. In still other embodiments, the device 100 may be used to estimate whether or not the amount of water in the fluid 102 is above or below a specified value. As used herein, the term "estimating water content" refers to any of those types of evaluating water presence or any other manner in characterizing the presence or amount of water in the flowing fluid 102. The accuracy of the estimation may depend on factors such as prevailing conditions or the type of equipment.

In one embodiment, the monitoring device 100 may include an enclosure 104 having an interior space 106 for receiving a reactive permeable media 110. The interior space 106 may be configured to channel the flowing fluid 102 from an inlet 108 to an outlet 109. The flowing fluid 102 flows along the media 110 in the space 106. Depending on the particular configuration, the flowing fluid 102 may flow around and/or through the media 110. One or more sensors 120 may be positioned on or near the enclosure 104. As will be described in greater detail below, the reactive media 110 interacts with a selected component of the flowing fluid 102 to control a flow parameter of the along the space 106. Illustrative flow parameters include, but are not limited to, pressure, flow rate, and flow resistance. The sensors 120 are directly or indirectly responsive to the flow parameter(s) and generate signals that may be used by an analyzer 130 to estimate water content.

In embodiments, the reactive permeable media 110 may include a water sensitive media. One non-limiting example of a water sensitive media is a Relative Permeability Modifier (RPM). Materials that may function as a RPM are described in U.S. Pat. Nos. 6,474,413, 7,084,094, 7,159,656, and 7,395,858, which are hereby incorporated by reference for all purposes. The Relative Permeability Modifier may be a hydrophilic polymer. This polymer 112 may be used alone or in conjunction with a substrate 114. In one application, the polymer may be bonded to individual particles of a substrate. Example substrate materials include sand, gravel, beads, metal balls, ceramic particles, and inorganic particles, or another material that is stable in a down-hole environment. The substrate may also be another polymer. Additionally, a polymer may be infused through a permeable material such as a sintered metal bead pack, ceramic material, permeable natural formations, etc. Thus in some embodiments, the media 110 may be formed of solid or semi-solids that flow like a fluid. In other embodiments, the media 110 may be a solid body such as permeable foam of the polymer may be constructed from the reactive media.

During use, the RPM media 110 varies resistance to fluid flow based on the amount of water in the flowing fluid 102. In some arrangements, the reactive media 110 increases flow resistance as water content in the flowing fluid 102 increases. In such arrangements, the increased flow resistance has a corresponding increase in the pressure differential across the reactive media 110.

One manner of increasing flow resistance is through a volumetric increase in the reactive media 110. In one non-limiting example, when water flows in, around or through RPM modified permeable media, the hydrophilic polymers coated on the particles expand to reduce the available cross-sectional flow area for the fluid flow channel, which increases resistance to fluid flow. When oil and/or gas flow through this permeable media, the hydrophilic polymers shrink to open the flow channel for oil and/or gas flow.

Another manner of increasing flow resistance may include providing a hydrophilic layer or other material that attracts water molecules. The attraction of water molecules by the material may increase flow resistance as water content in the flowing fluid 102 increases. In such embodiments, the reactive media 110 is volumetrically stable (e.g., does substantially not swell or expand).

Still another manner of increasing flow resistance may include using reactive materials that extend polymer chains into interstitial flow pores. A water monitoring device may use a water-soluble, high molecular weight polymer (e.g., an RPM polymer) that is coated on solid particles, such as sand, glass beads, and ceramic proppants. The material may be packed under high pressure to form consolidated homogenous and high porosity porous medium. When a fluid that includes water flows through the interstitial flow channels of the packed media, the coated polymers extend their polymer chains into the pore flow channels, resulting in increase fluid flow resistance. When oil flows through the packed media, the polymer chains shrink back to open the flow channels wider for oil flow.

In embodiments wherein the monitoring device 100 is used for estimating water cut, it may be desirable to select a reactive media 110 that reacts with water. However, where it is desired to estimate the amount of another fluid or substance in a flowing fluid, the reactive media 110 may be selected to interact with a substance other than water. Illustrative substances may include, but are not limited to, additives (emulsifiers, surfactants, etc.), engineered or human-made materials (e.g., cement, fracturing fluid, etc.), naturally occurring materials (liquid oil, natural gas, asphaltines, etc.).

In embodiments, the sensor(s) 120 may generate signals indicative of one or more selected flow parameters associated with the flowing fluid 102. As noted previously, illustrative flow parameters include, but are not limited to, pressure, flow rate, and resistance to flow. These flow parameters may be affected by water content and changes in water content. Thus, determining these parameters may be used to estimate water content in the flowing fluid 102.

In some embodiments, the sensor(s) 120 may directly measure a flow parameter. For example, pressure sensor(s) 122, 124 may be used to obtain pressure values for the flowing fluid 102. Also, by positioning the pressure sensors 122, 124 at opposing locations along the space 106, a pressure differential value across the media 110 may be obtained for the flowing fluid 102.

In some embodiments, the sensors(s) 120 may indirectly measure a flow parameter. For example, pressure may be estimated by measuring flexure or displacement of a body or member caused by a force generated by that pressure. In one arrangement, a flexible wall 126 or diaphragm may be simply supported along the flow path. One or more strain sensors 128 may be fixed to a portion of the wall 126 that flexes, bends or otherwise deforms due to pressure in the space 106. In the illustrated embodiment, the wall 126 forms a portion of the enclosure 104 containing the reactive media 110. However, the flexing wall 126 may be formed as a separate element in pressure communication with the flowing fluid 102.

The information obtained by the sensors 120 may be received by an analyzer 130 programmed to estimate a water content of the flowing fluid 102. The analyzer 130 may be positioned locally or may be positioned remotely. That is, for example, the analyzer 130 may be positioned at a subsurface location or at a surface location. Moreover, while the illustrated embodiment shows a direct connection 132 between the sensors 120 and the analyzer 130, in some embodiments, information from the sensors 120 may be stored and retrieved at a later time. That is, the analyzer 130 may estimate water content in real-time or periodically. The connection 132 may be a physical and/or non-physical signal conveying media (e.g., metal wire, optical fibers, EM signals, acoustic signals, etc.).

In embodiments, the analyzer 130 may include an information processing device having suitable memory modules and programming to estimate water content. For instance, the programs may include mathematical models based on Darcy's Law. As is known, Darcy's Law is an expression of the proportional relationship between the instantaneous discharge rate through a permeable medium, the viscosity of the fluid, and the pressure drop over a given distance. Such fluid behavior models may be used to establish relationships between flow parameters (e.g., pressure differentials) and water content. The programs may also include models based on empirical data. For instance, a model may use test data that is representative of changes in a selected flow parameter caused by changes in water content. The test data may, for example, be changes in pressure differentials across the reactive media for a given water cut.

Figure 2A:
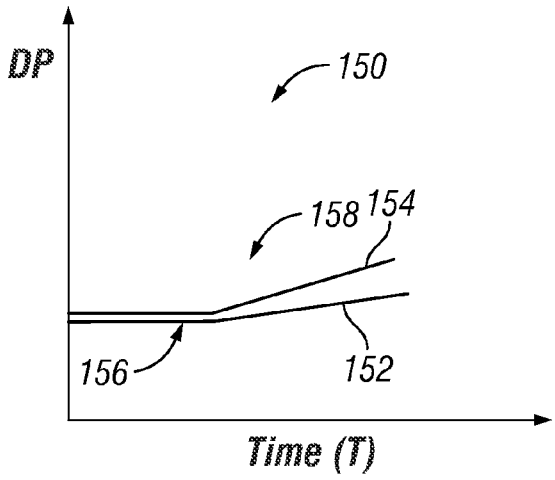
FIGS. 2A and 2B are graphs illustrating exemplary relationships between differential pressure and different water cuts.

Referring now to FIG. 2A, there is shown a graph 150 illustrative of empirical data that may be used to develop models for estimating water cut. The graph 150 plots changes in differential pressure (DP) across a reactive media over time (T). Line 152 illustrates a water cut of five percent and line 154 illustrates a water cut of ten percent. Initially, at time period 156, there is no appreciable change differential pressure because the amount of water is negligible. At time period 158, the increased water cuts cause an increase in pressure differentials. The ten percent water cut 154 causes a faster increase in differential pressure than the five percent water cut 152.

Figure 2B:
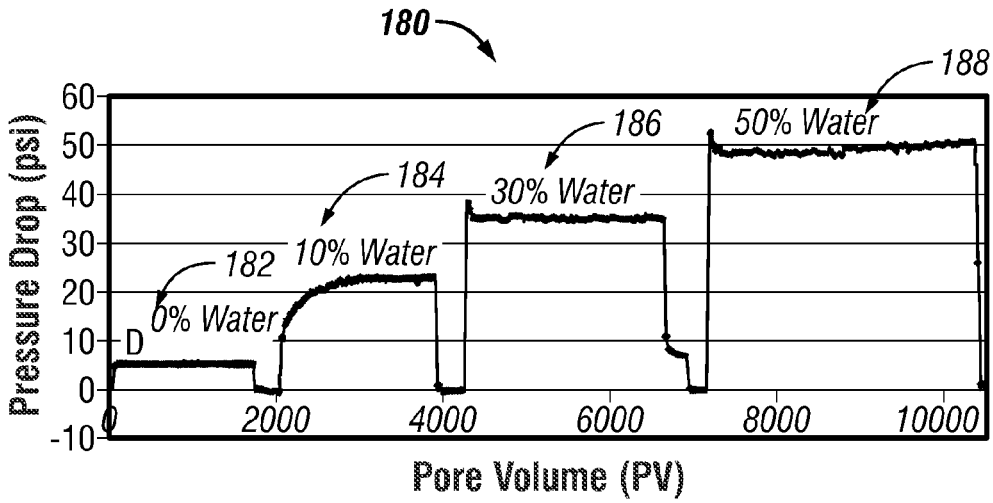

Referring now to FIG. 2B, there is shown another graph 180 illustrative of empirical data that may be used to develop models for estimating water cut. The graph 180 is representative of data acquire using simulated formation brine and diesel. The graph 180 plots changes in differential pressure (DP) (PSI) versus pore volume (a dimensionless value). Lines 182, 184, 186, 188 represent fluid streams having water cuts of zero, ten, thirty and fifty percent, respectively. At one end of the experimental range, line 182 shows a fluid stream of only diesel. At the other end, line 188 shows a fluid stream of equal parts (fifty percent) of brine and diesel. As can be seen, the pressure drop values for each of the lines 182, 184, 186, 188 stabilize at or reach a steady state at distinctly different values. Thus, an estimated pressure drop value may indicative of a distinct or discernable water cut. Of course, interpolation or extrapolation may also be used to estimate a water cut based on an estimated pressure drop value. Generally, the stabilized or steady state pressure value increases as the water cut value increases.

Therefore, one or more models based on the FIGS. 2A and/or 2B relationships may use parameters such as time, pore volume, and pressure data to estimate water cut.

It should be appreciated that embodiments of the present disclosure may be used in a variety of situations. That is, the monitoring device 100 may be used in hydrocarbon producing wells, at the surface in pipelines, or any other situation wherein it may be desirable to estimate water cut. Also, the monitoring device may be constructed as a stand-alone device or a component in a larger system. Also, in certain embodiments, aspects of the monitoring device 100 may be incorporated into a flow-control device that uses a reactive media.

Figure 3:
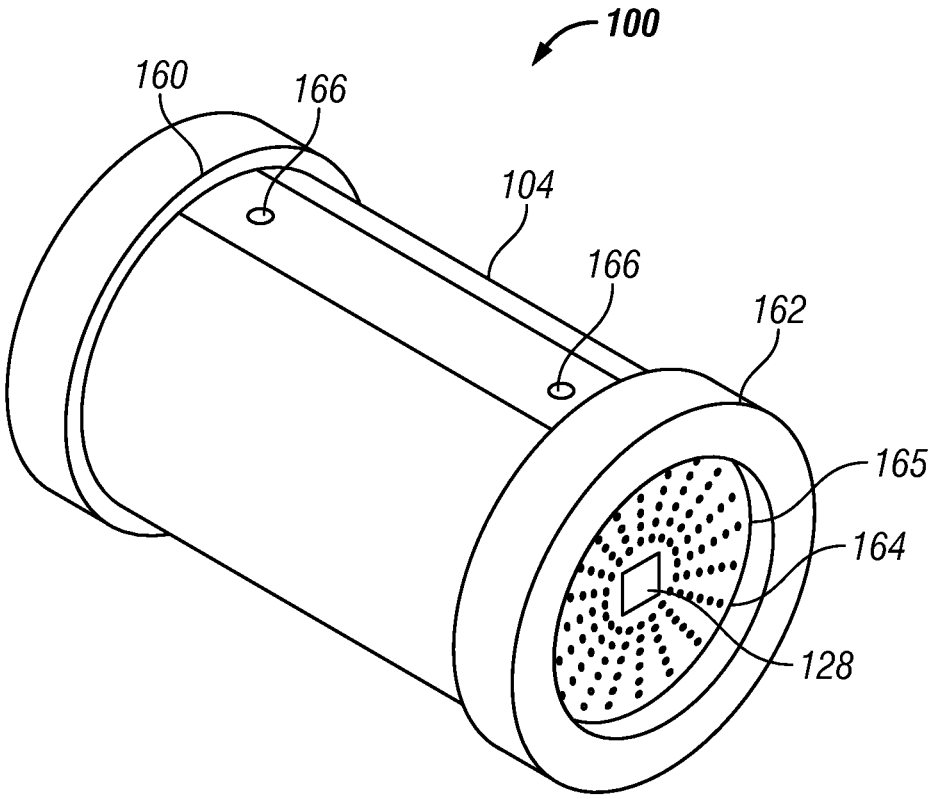
FIG. 3 is an isometric view of an exemplary water monitoring device made in accordance with one embodiment of the present disclosure.

Referring FIG. 3, there is isometrically shown a water monitoring device 100 suitable for use for estimating water cut. This embodiment includes an enclosure 104 formed as a cylinder that has an interior flow space (not shown) for receiving a reactive permeable media (not shown). The reactive permeable media is confined within the flow space by retaining members 160, 162. Each retaining member 160, 162 includes perforations 164 or openings through which fluid can enter and exit the enclosure 104. One of the retaining members, here member 162, may include a simply supported diaphragm 165 on which a strain sensor 128 is positioned. Also, the enclosure 104 includes ports 166 that provide pressure communication between the interior space and pressure sensors (not shown). Information from the sensors may be sent to an analyzer 130 (FIG. 1) to estimate water content.

Figure 4:
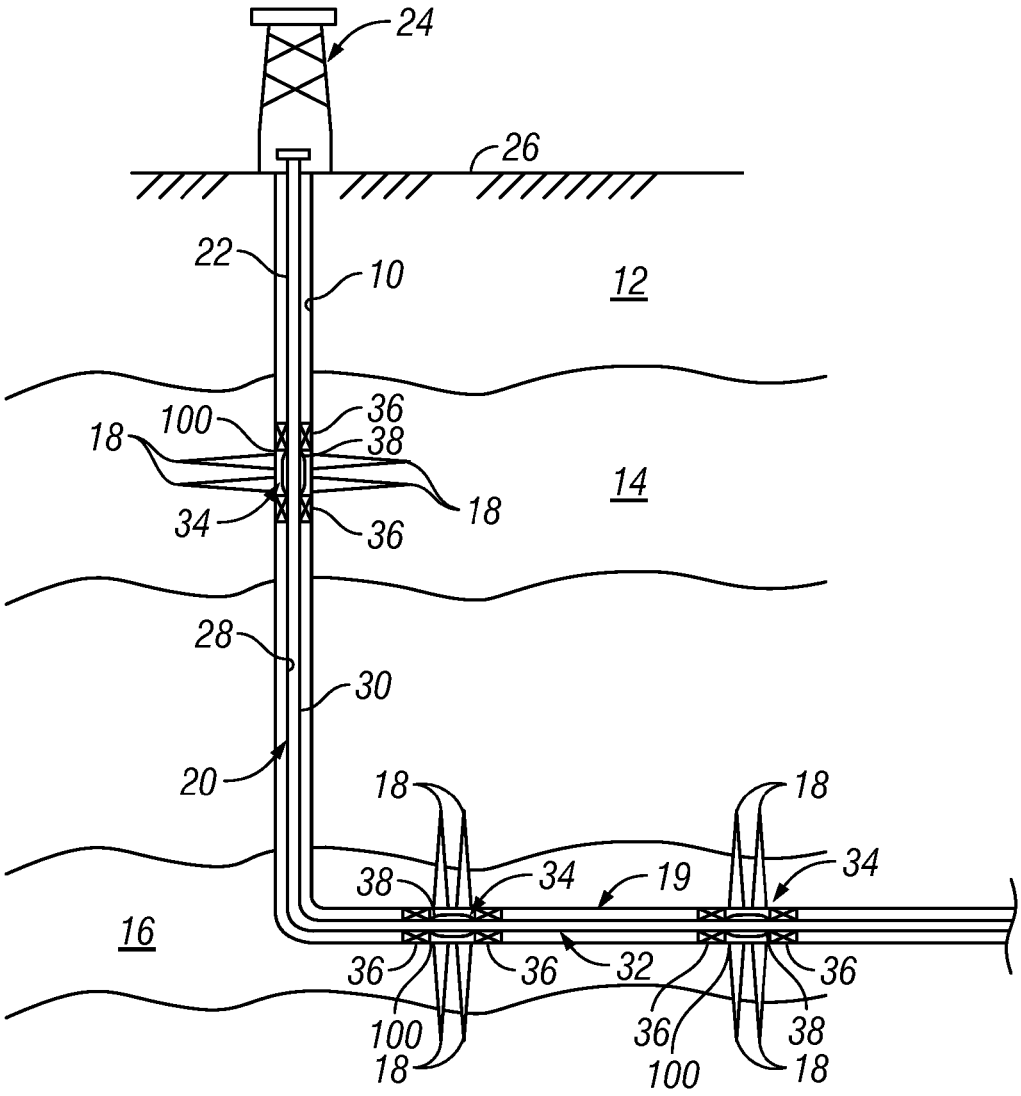
FIG. 4 is a schematic elevation view of an exemplary multi-zonal wellbore and production assembly which incorporates an in-flow control system in accordance with one embodiment of the present disclosure.

Referring now to FIG. 4, a water monitoring device may also be used in conjunction with a well completion system for controlling production of hydrocarbons from a subsurface formation. As shown in FIG. 4, a wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated, or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flowbore 28 along its length. An annulus 30 is defined between the production assembly 20 and the wellbore casing. The production assembly 20 has a deviated, generally horizontal portion 32 that extends along the deviated leg 19 of the wellbore 10. Production devices 34 are positioned at selected points along the production assembly 20. Optionally, each production device 34 is isolated within the wellbore 10 by a pair of packer devices 36. Although only two production devices 34 are shown in FIG. 4, there may, in fact, be a large number of such production devices arranged in serial fashion along the horizontal portion 32.

The production devices 34 may include flow devices for controlling the flow of fluids from a reservoir into a production string. In one embodiment, the production devices 34 includes a particulate control devices for reducing the amount and size of particulates entrained in the fluids and an in-flow control device 38 that controls overall drainage rate from the formation. The in-flow control devices 38 may be mechanically, electrically, and/or hydraulically actuated and may include valves, valve actuators, and any other devices suited for controlling flow rates. In some embodiments, the monitoring device 100 may be programmed to control the in-flow control device 38. For example, the monitoring device 100 may be programmed to adjust a flow through the in-flow control device 38 in response to estimated water content. In one arrangement, the device 100 may choke or reduce flow as water content increases (e.g., crosses a preset threshold). In other embodiments, the device 100 may close the in-flow control device to completely block fluid in-flow. The device 100 may also be programmed to increase flow if water content drops. Also, in embodiments wherein a reactive media is used in the in-flow control device 38, one or more flow parameters associated with that in-flow control device 38 may be used to estimate water content.

In aspects, what has been described includes in part, a method of building water sensitive porous medium (WSPM) as watercut sensor to control downhole water production through installing WSPMs inside of wellbore. The WSPM may be constructed of water-soluble, high molecular weight polymers (relative permeability modifier (RPM)) which are coated on solid particles, such as sand, glass beads, and ceramic proppants. The WSPM may be packed under high pressure to form consolidated homogenous and high porosity porous medium. The size of the particles may range from 10 to 100 mesh. Optionally, after the polymers are fully hydrolyzed in water or brine, the polymers can be crosslinked with crosslinking agents. The solid particles may be mixed with the polymer solution in a blender under certain ratio, (weight of solid particles: weight of dry polymer=1000: (0.1 to 100). As blender or mixer is continuously stirring the mixture of solid particles and polymer solution, blowing air, hot air, nitrogen, or vacuuming may be added to the mixture to make polymer dry or partially dry. Thereafter, the polymer coated particles may be loaded into a container to pack into consolidated porous medium. The packing pressure may from 50 to 1000 psi. When formation water flows through the WSPM interstitial flow channels, the coated polymers extend their polymer chains into the pore flow channels, resulting in increase fluid flow resistance. When oil flows through the WSPM, the polymer chains shrink back to open the flow channels wider for oil flow. This flow resistance attribute may be repeatable and reversible as water/oil fluid composition varies. When water mixed with oil flows through the WSPM, the magnitude in pressure drop across the flow channels depends on the percentages of water in the mixture (water/oil ratio, or WOR). Higher water cuts result in higher resulting pressure drops.

It should be understood that the present disclosure is not limited to any particular well configuration or use. The borehole 10 may be used to access geothermal sources, water, hydrocarbons, minerals, etc. and may also be used to provide conduits or passages for equipment such as pipelines. Furthermore, while the reactive media has been described as interacting with water, it should be appreciated that for certain application the reactive material may be configured to interact with other substances (e.g., liquid oil, natural gas, asphaltines, engineered fluids, man-made fluids, etc.).

For the sake of clarity and brevity, descriptions of most threaded connections between tubular elements, elastomeric seals, such as o-rings, and other well-understood techniques are omitted in the above description. Further, terms such as "valve" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

The invention claimed is:

1. An apparatus for estimating a parameter of interest relating to a fluid, comprising:

a conduit having a flexing member;

a reactive media in the conduit, the reactive media interacting with a selected fluid component to control a flow parameter of the conduit; and at least one sensor responsive to the flow parameter, the flow parameter being affected by interaction of the reactive media with the selected fluid component, wherein the at least one sensor includes a strain sensor sensing a response of the flexing member to the flow parameter.

2. The apparatus of claim 1, wherein the at least one sensor generates a signal representative of a water content of the fluid in the conduit.

3. The apparatus of claim 1, wherein the at least one sensor include a pressure sensor in pressure communication with the fluid in the conduit.

4. The apparatus of claim 1, wherein the flow parameter is selected from one of: (i) pressure, (ii) flow rate, and (iii) resistance to flow.

5. An apparatus for estimating a parameter of interest relating to a fluid, comprising:

a conduit;

a reactive media in the conduit, the reactive media interacting with a selected fluid component to control a flow parameter of the conduit; and at least one sensor responsive to the flow parameter, the flow parameter being affected by interaction of the reactive media with the selected fluid component, wherein the reactive media includes particles coated with a relative permeability modifier polymer.

6. The apparatus of claim 5, wherein the at least one sensor generates a signal representative of a water content of the fluid in the conduit.

7. The apparatus of claim 6, wherein the at least one sensor include a pressure sensor in pressure communication with the fluid in the conduit.

8. The apparatus of claim 6, wherein the conduit includes a flexing member; and wherein the at least one sensor includes a strain sensor sensing a response of the flexing member to the flow parameter.

9. The apparatus of claim 5, wherein the reactive media includes a relative permeability modifier polymer.

10. The apparatus of claim 5, wherein the flow parameter is selected from one of: (i) pressure, (ii) flow rate, and (iii) resistance to flow.

11. An apparatus for estimating a water content of a fluid flowing from a subterranean formation, comprising:

a flow path configured to convey fluid from the formation;

a reactive media in the flow path;

a flexing member positioned along the conduit, the flexing member responsive to a pressure change in the flow path caused by an interaction of the reactive media with water; and at least one sensor sensing a response of the flexing member to the interaction of the reactive media with water.

12. The apparatus of claim 11, wherein the at least one sensor include a pressure sensor in pressure communication with the fluid in the flow path.

13. The apparatus of claim 11, wherein the at least one sensor includes a strain sensor.

14. The apparatus of claim 11, wherein the reactive media includes particles coated with a relative permeability modifier polymer.

15. The apparatus of claim 11, wherein the reactive media increases flow resistance in the flow path upon interacting with water.

16. The apparatus of claim 11, further comprising an analyzer configured to estimate a water content of the fluid in the container using information generated by the sensor.

17. The apparatus of claim 11, wherein the reactive media is a permeable media having spaces through which the flow fluid flows.

* * * * *